US010002695B2

(12) United States Patent
Haga et al.

(10) Patent No.: US 10,002,695 B2
(45) Date of Patent: Jun. 19, 2018

(54) METHOD FOR MANUFACTURING RARE-EARTH MAGNETS

(71) Applicant: TOYOTA JIDOSHA KABUSHIKI KAISHA, Toyota-shi, Aichi (JP)

(72) Inventors: Kazuaki Haga, Toyota (JP); Tomonori Inuzuka, Toyota (JP); Yuya Ikeda, Toyota (JP)

(73) Assignee: TOYOTA JIDOSHA KABUSHIKI KAISHA, Toyota-shi, Aichi-ken (JP)

( * ) Notice: Subject to any disclaimer, the term of this patent is extended or adjusted under 35 U.S.C. 154(b) by 247 days.

(21) Appl. No.: 14/829,807

(22) Filed: Aug. 19, 2015

(65) Prior Publication Data

US 2016/0099104 A1 Apr. 7, 2016

(30) Foreign Application Priority Data

Oct. 3, 2014 (JP) ..... 2014-204900

(51) Int. Cl.
*H01F 1/057* (2006.01)
*B22F 3/02* (2006.01)
*B22F 3/17* (2006.01)

(52) U.S. Cl.
CPC ..... *H01F 1/0576* (2013.01); *B22F 3/02* (2013.01); *B22F 3/17* (2013.01); *B22F 2003/026* (2013.01); *B22F 2998/10* (2013.01); *H01F 1/0577* (2013.01)

(58) Field of Classification Search
CPC ..... B22F 3/02; B22F 2003/026
See application file for complete search history.

(56) References Cited

U.S. PATENT DOCUMENTS 5,093,076 A * 3/1992 Young ..... B22F 3/02 148/101
2001/0016174 A1* 8/2001 Tsuchida ..... B22F 1/02 419/38
2009/0305918 A1* 12/2009 Bugner ..... C10M 111/02 508/118

FOREIGN PATENT DOCUMENTS

JP 1-171204 A 7/1989
JP 01-248503 A 10/1989
JP 6-238500 A 8/1994
JP 06-346102 A 12/1994
JP 9-129465 A 5/1997
JP 2000-144206 A 5/2000
(Continued)

*Primary Examiner* — Colleen P Dunn
*Assistant Examiner* — Rajinder Bajwa
(74) *Attorney, Agent, or Firm* — Sughrue Mion, PLLC

(57) ABSTRACT

Provided is a method for manufacturing a rare-earth magnet having good workability and capable of manufacturing a rare-earth magnet having low oxygen density. A method for manufacturing a rare-earth magnet includes: a first step of applying or spraying graphite-based lubricant GF on an inner face of a forming die M, and charging magnetic powder MF as a rare-earth magnet material in the forming die M, followed by cold forming, to form a cold-forming compact 10 having a surface on which a graphite-based lubricant coat 12 is formed; a second step of performing hot forming to the cold-forming compact 10 to form a sintered body 20 having a surface on which a graphite-based lubricant coat 22 is formed; and a third step of, in order to give the sintered body 20 anisotropy, performing hot deformation processing to the sintered body 20 to form the rare-earth magnet 30.

1 Claim, 8 Drawing Sheets

(56) References Cited

FOREIGN PATENT DOCUMENTS

JP 2005-232473 A 9/2005

* cited by examiner

METHOD FOR MANUFACTURING RARE-EARTH MAGNETS

CLAIM OF PRIORITY

The present application claims priority from Japanese patent application JP 2014-204900 filed on Oct. 3, 2014, the content of which is hereby incorporated by reference into this application.

BACKGROUND

Technical Field

The present invention relates to a method for manufacturing a rare-earth magnet.

Background Art

Rare-earth magnets containing rare-earth elements such as lanthanoide are called permanent magnets as well, and are used for motors making up a hard disk and a MRI as well as for driving motors for hybrid vehicles, electric vehicles and the like.

Indexes for magnet performance of such rare-earth magnets include remanence (residual flux density) and a coercive force. Meanwhile, as the amount of heat generated at a motor increases because of the trend to more compact motors and higher current density, rare-earth magnets included in the motors also are required to have improved heat resistance, and one of important research challenges in the relating technical field is how to keep magnetic characteristics of a magnet operating at high temperatures.

Rare-earth magnets include typical sintered magnets including crystalline grains (main phase) of about 3 to 5 μm in scale making up the structure and nano-crystalline magnets including finer crystalline grains of about 50 nm to 300 nm in nano-scale. Among them, nano-crystalline magnets capable of decreasing the amount of expensive heavy rare-earth elements to be added or not including such heavy rare-earth elements added while making the crystalline grains finer attract attention currently.

The following briefly describes one example of the method for manufacturing a rare-earth magnet. For instance, in a typical method, Nd—Fe—B molten metal is solidified rapidly to be fine powder (magnetic powder), while pressing-forming the fine powder to be a sintered body. Hot deformation processing is then performed to this sintered body to give magnetic anisotropy thereto to prepare a rare-earth magnet (orientational magnet). The hot deformation processing is performed by extrusion such as backward extrusion or forward extrusion, or upsetting (forging), for example.

Meanwhile it is known that, in each step of such a manufacturing process including the preparation and conveyance of magnetic powder, the preparation of a sintered body and the preparation of a rare-earth magnet, a product in process may come into contact with the air (oxygen thereof), and so the oxygen density in the composition of the product in process may increase or the product in process may be oxidized, and the final rare-earth magnet may have degraded magnetic performance, such as in coercive force. For instance, it is known that, during the hot deformation processing, oxygen contained in a magnet material destroys the Nd—Fe—B main phase, which becomes a factor to decrease the residual flux density and the coercive force. It is further known that, during grain-boundary diffusion of a modified alloy to recover the coercive force after hot deformation processing as well, oxygen left inside becomes a factor to inhibit the modifier alloy from permeating through the inside. It is also known that oxygen taken in a magnet reacts with a rare-earth element in the grain-boundary phase to form an oxide, and so the component in the grain-boundary phase that is effective to separate the main phase magnetically decreases, resulting in a decrease in coercive force of the rare-earth magnet.

To avoid these problems, a technique to avoid a contact with oxygen in the manufacturing process of a rare-earth magnet or to decrease the oxygen density has been proposed and been put to practical use.

For instance, Patent Documents 1, 2 disclose a technique of storing magnetic powder for rare-earth magnet in an airtight vessel filled with inert gas, and performing sintering while supplying powder from this vessel to a mold.

Patent Document 3 discloses a method for manufacturing a rare-earth magnet, in which magnetic powder for rare-earth magnet is charged in a metal can, followed by hermetical-sealing while evacuating, and then hot extrusion pressing is performed by heating this can to manufacture a rare-earth magnet.

Patent Document 4 then discloses a method for manufacturing a rare-earth magnet of surrounding a rare-earth magnet ingot with a metal material for hermetically-sealing, followed by hot processing.

According to the techniques disclosed in these Patent Documents, the density of oxygen that comes into contact with magnetic powder, a sintered body and the like during the manufacturing process of a rare-earth magnet can be reduced.

The manufacturing methods disclosed in Patent Documents 1, 2, however, include the step of charging magnetic powder into a mold from an airtight vessel, and so its workability is not good. Additionally, these methods are time-consuming and the cost is required to prepare a vessel, and so the manufacturing cost will increase.

In the manufacturing methods disclosed in Patent Documents 3 and 4, a metal can, for example is hot-pressed. Herein, since Nd—Fe—B magnetic powder for rare-earth magnet tends to be oxidized more than general metal, the magnetic powder inside of the metal can is easily oxidized prior to oxidation of the metal can, for example. In this way, a large effect to suppress oxidation of metal powder cannot be expected.

RELATED ART DOCUMENTS

Patent Documents

Patent Document 1: JP H06-346102 A
Patent Document 2: JP 2005-232473 A
Patent Document 3: JP H01-248503 A
Patent Document 4: JP H01-171204 A

SUMMARY

In view of the aforementioned problems, the present invention aims to provide a method for manufacturing a rare-earth magnet having good workability and capable of manufacturing a rare-earth magnet having low oxygen density.

To fulfill the object, a method for manufacturing a rare-earth magnet of the present invention includes: a first step of applying or spraying graphite-based lubricant on an inner face of a forming die, and charging magnetic powder as a rare-earth magnet material in the forming die, followed by cold forming, to form a cold-forming compact having a surface on which a graphite-based lubricant coat is formed;

a second step of performing hot forming to the cold-forming compact to form a sintered body having a surface on which a graphite-based lubricant coat is formed; and a third step of, in order to give the sintered body anisotropy, performing hot deformation processing to the sintered body to form the rare-earth magnet.

The manufacturing method of the present invention is to manufacture a rare-earth magnet, including applying or spraying graphite-based lubricant on an inner face of a forming die, followed by cold-forming of magnetic powder in the forming die to form a cold-forming compact having a surface on which a graphite-based lubricant coat is formed, performing hot forming of this cold-forming compact to form a sintered body having a surface on which a graphite-based lubricant coat is formed; and performing hot deformation processing of the sintered body to form the rare-earth magnet. This manufacturing method surrounds the magnetic powder, the sintered body and the rare-earth magnet as a final product with graphite-based lubricant and graphite-based lubricant coats during the manufacturing process, whereby contact with the air (oxygen thereof) can be minimized, and so the rare-earth magnet having the effect of suppressing oxidation and so low oxygen density and having excellent magnetic performance can be manufactured.

This manufacturing method has another advantage of having a similar object to the conventional manufacturing method to reduce oxygen density and prevent oxidation of a product, and not requiring an expensive manufacturing booth equipped with an inert gas control mechanism as well as sophisticated inert gas atmosphere control because there is no need to manufacture the magnet in inert gas atmosphere as in the conventional manufacturing method. Note here that the step of preparing magnetic powder from rapidly quenched ribbon is typically performed in the vacuum atmosphere. Since the magnetic powder that is prepared by this method is at normal temperature when it is placed in the forming die having the inner face to which graphite-based lubricant is applied, for example, oxidation of the magnetic powder hardly pose a problem even when the magnetic powder is placed in the forming die having the inner face to which graphite-based lubricant coat is applied or the like in the air atmosphere. A problem of oxidation of a magnet material becomes prominent when the material is processed in high-temperature atmosphere, and so the manufacturing method of the present invention is effective to prevent oxidation at the step of preparing a sintered body by hot forming (sintering) of a cold-forming body, and manufacturing a rare-earth magnet by hot deformation processing of the sintered body.

In the manufacturing method of the present invention, graphite-based lubricant is used as lubricant that is to be applied, for example, on the inner face of a forming die for cold-forming at least. Herein, examples of the "graphite-based lubricant" used include lubricant containing scale-like graphite powder or spherical carbon particles. Among them, scale-like graphite powder can lead to good lubricating property in the forming die or in the die because scales of such scale-like graphite are overlapped with each other during hot forming of a cold-forming compact having a surface on which a graphite-based lubricant coat is formed and during hot deformation processing of a sintered body having a surface on which a graphite-based lubricant coat is formed.

Since graphite tends to be oxidized more than rare-earth magnetic powder such as Nd—Fe—B, the graphite-based lubricant coat is oxidized prior to oxidation of the rare-earth magnet material in a high-temperature atmosphere for hot forming or hot deformation processing, which results in suppression of oxidation of the rare-earth magnet material in the graphite-based lubricant coat.

As can be understood from the descriptions, the manufacturing method of the present invention is to manufacture a rare-earth magnet, including applying or spraying graphite-based lubricant on an inner face of a forming die, followed by cold-forming of magnetic powder in the forming die to form a cold-forming compact having a surface on which a graphite-based lubricant coat is formed, performing hot forming of this cold-forming compact to form a sintered body having a surface on which a graphite-based lubricant coat is formed; and performing hot deformation processing of the sintered body to form the rare-earth magnet. This manufacturing method surrounds the magnetic powder, the sintered body and the rare-earth magnet as a final product with graphite-based lubricant and graphite-based lubricant coats during the manufacturing process, whereby contact with the air (oxygen thereof) can be minimized, and so the rare-earth magnet having so low oxygen density and having excellent magnetic performance can be manufactured without requiring the manufacturing in inert gas atmosphere.

DETAILED DESCRIPTION OF THE EMBODIMENT(S)

The following describes an embodiment of a method for manufacturing a rare-earth magnet of the present invention, with reference to the drawings. For the purpose of illustration, the drawings show the same forming die for first to third steps, and naturally a forming die specific to each step may be used.

(Embodiment of Method for Manufacturing a Rare-Earth Magnet)

Figure 1:
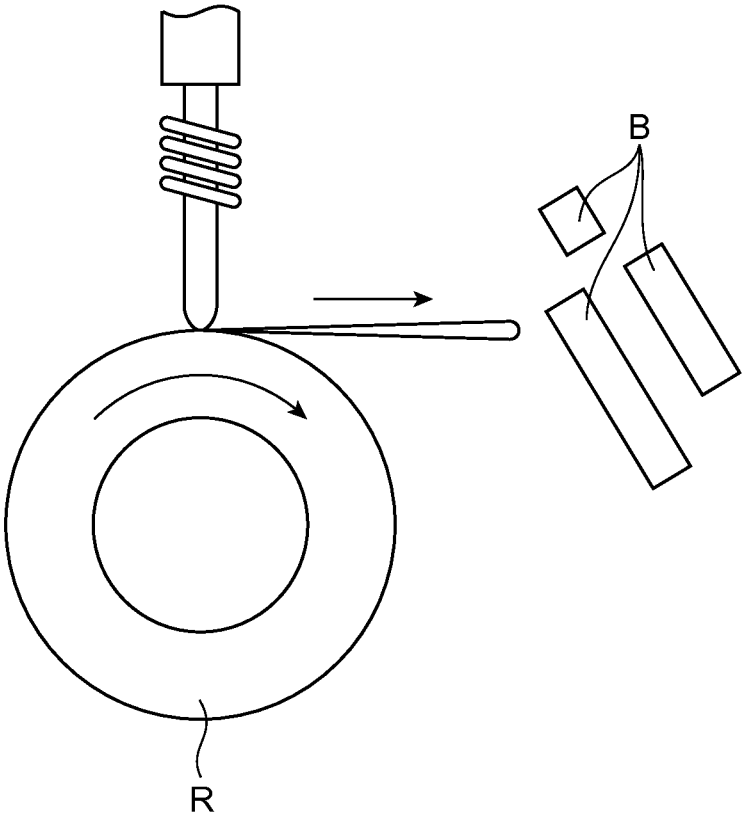
FIG. 1 schematically describes a method for manufacturing magnetic powder that is used in a first step of a method for manufacturing a rare-earth magnet of the present invention.

The manufacturing method of the present invention begins with a first step, where graphite-based lubricant is applied or sprayed on the inner face of a forming die, and magnetic powder as a rare-earth magnet material is loaded in the forming die, followed by cold forming, so that a cold-forming compact having a surface on which a graphite-based lubricant coat is formed is prepared. FIG. 1 schematically describes a method for manufacturing magnetic powder that is used in the first step.

For instance, alloy ingot is molten at a high frequency, and a molten composition giving a rare-earth magnet is injected to a copper roll R to manufacture a melt-spun ribbon B (rapidly quenched ribbon) by a melt-spun method using a single roll in an oven (not illustrated) at reduced pressure of 50 kPa or lower, for example.

The melt-spun ribbon B obtained is then coarse-ground to prepare magnetic powder. At this time, the magnetic powder has the adjusted grain size that is in the range from 75 to 300 μm.

Figure 2:
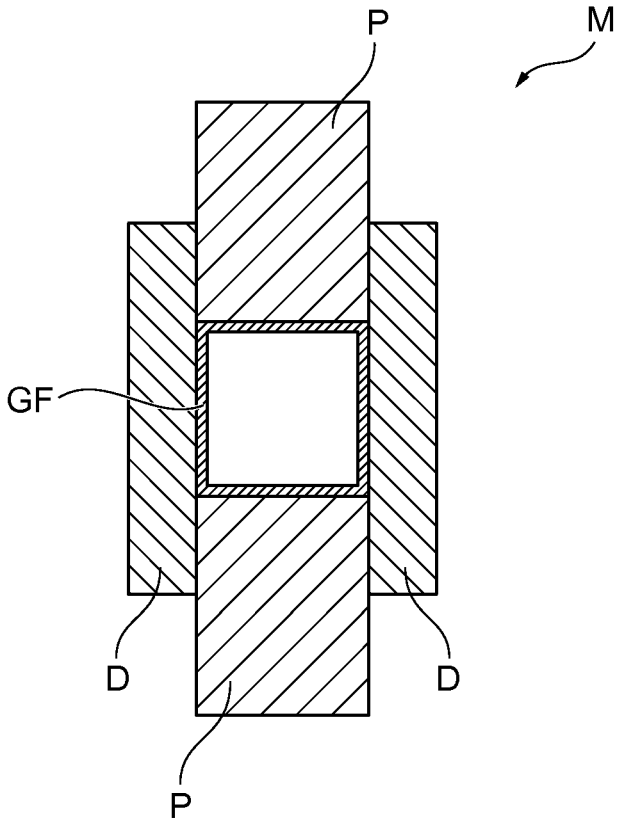
FIG. 2 schematically describes the first step of the method for manufacturing a rare-earth magnet.

Referring next to FIGS. 2 and 3, the first step is described. Firstly as illustrated in FIG. 2, graphite-based lubricant GF made of graphite powder is applied or sprayed on the inner face of a forming die M made up of a carbide die D and a carbide punch P sliding along the hollow of the carbide die.

Figure 3A:
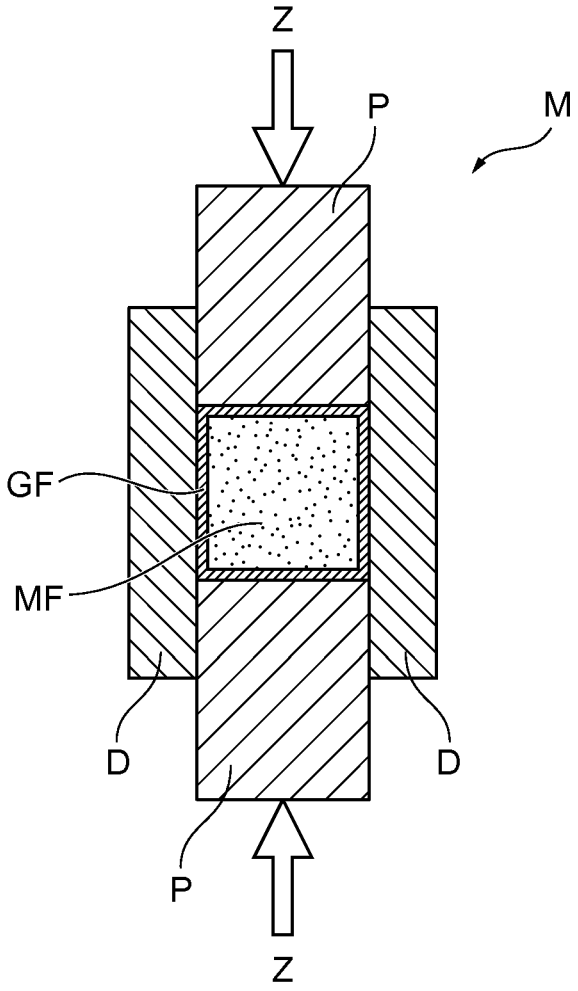
FIG. 3A schematically describes the first step of the manufacturing method, following FIG. 2.
Figure 3B:
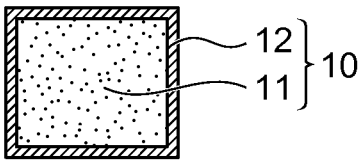
FIG. 3B illustrates a cold-forming compact prepared at the first step.

Next, as illustrated in FIG. 3A, magnetic powder MF is placed (loaded) in a cavity defined by the carbide die D and the carbide punch P. Then cold forming is performed while applying pressure with the carbide punch P (Z direction), whereby a cold-forming compact 10 is manufactured, including a compact 11 having a surface on which a graphite-based lubricant coat 12 is formed as illustrated in FIG. 3B (first step). This cold-forming compact 10, for example, includes a Nd—Fe—B main phase (having the average grain size of 300 nm or less, and having the crystalline grain size of about 50 nm to 200 nm) of a nano-crystalline structure and a Nd—X alloy (X: metal element) grain boundary phase around the main phase.

Herein, the Nd—X alloy making up the grain boundary phase of the cold-forming compact 10 is an alloy containing Nd and at least one type of Co, Fe, Ga and the like, which may be any one type of Nd—Co, Nd—Fe, Nd—Ga, Nd—Co—Fe, Nd—Co—Fe—Ga, or the mixture of two types or more of them, and is in a Nd-rich state.

Figure 4A:
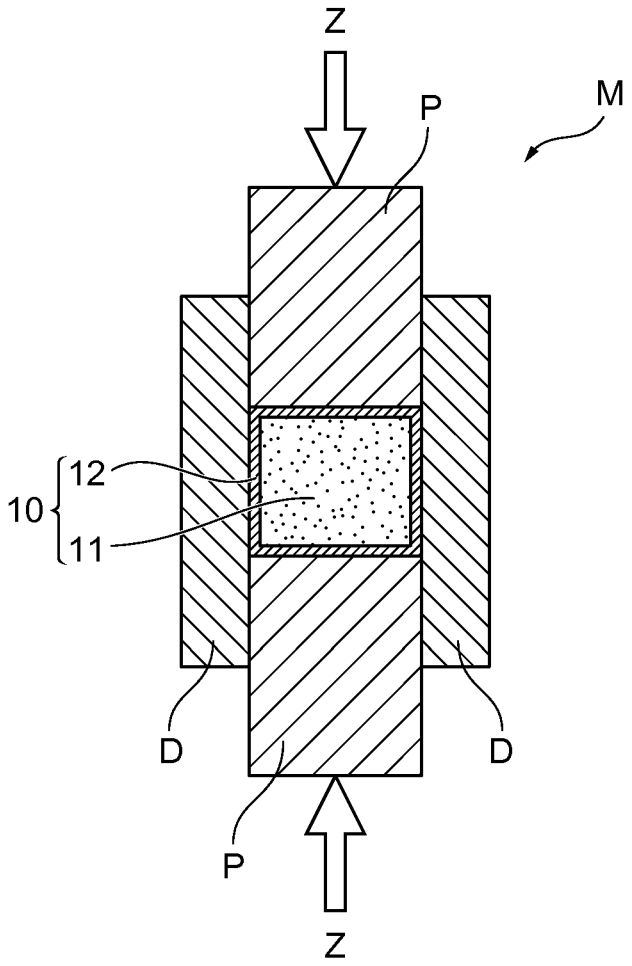
FIG. 4A schematically describes a second step of the manufacturing method.
Figure 4B:
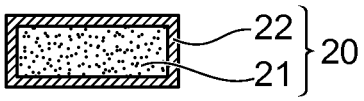
FIG. 4B illustrates a sintered body prepared at the second step.

Once the cold-forming compact 10 including the compact 11 having a surface on which the graphite-based lubricant coat 12 is formed is prepared in the first step, then as illustrated in FIG. 4A, the cold-forming compact 10 is then placed in the cavity defined by the carbide die D and the carbide punch P of the forming die M, and ormic-heating at about 700° C. is performed thereto while applying pressure with the carbide punch P (Z direction) and letting current flow through in the pressuring direction (hot forming), whereby a sintered body 20 is prepared, including a sintered main body 21 having a surface on which a graphite-based lubricant coat 22 is formed as illustrated in FIG. 4B (second step).

Figure 5A:
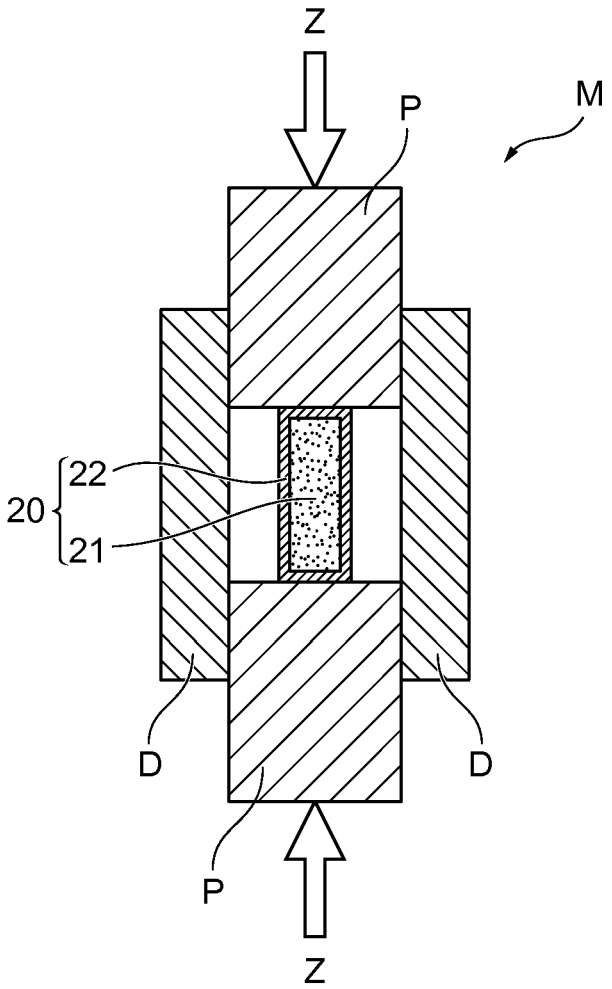
FIG. 5A schematically describes a third step of the manufacturing method.
Figure 5B:
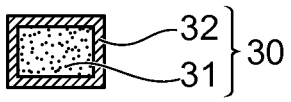
FIG. 5B illustrates a rare-earth magnet prepared at the third step.

Next, in order to give this sintered body 20 anisotropy, as illustrated in FIG. 5A, the sintered body 20 is placed again in the cavity defined by the carbide die D and the carbide punch P of the forming die M, and hot deformation processing is performed while applying pressure with the carbide punch P (Z direction), whereby a rare-earth magnet 30 including a rare-earth magnet main body 31 having a surface on which a graphite-based lubricant coat 32 is formed is prepared as illustrated in FIG. 5B (third step). The rate of strain is favorably adjusted at 0.1/sec. or more during hot deformation processing. When the degree of processing (rate of compression) by the hot deformation processing is large, e.g., when the rate of compression is about 10% or more, such hot deformation processing can be called heavily deformation processing. The hot deformation processing is favorably performed in the range of the degree of processing that is about 60 to 80%. When the rare-earth magnet 30 returns to normal temperature in the third step, then it is favorable to remove the graphite-based lubricant coat 32 around the rare-earth magnet main body 31.

Figure 6A:
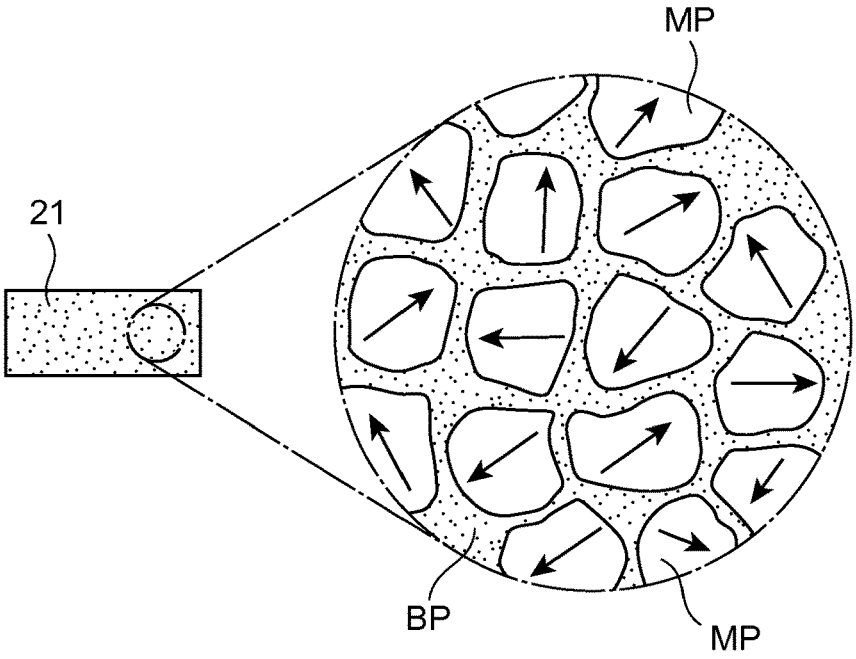
FIG. 6A describes a micro-structure of a sintered main body in FIG. 4B, and FIG. 6B describes a micro-structure of a rare-earth magnet main body in FIG. 5B.

As illustrated in FIG. 6A, the sintered main body 21 prepared in the second step shows an isotropic crystalline structure where the space between the nano-crystalline grains MP (main phase) is filled with the grain boundary phase BP.

Figure 6B:
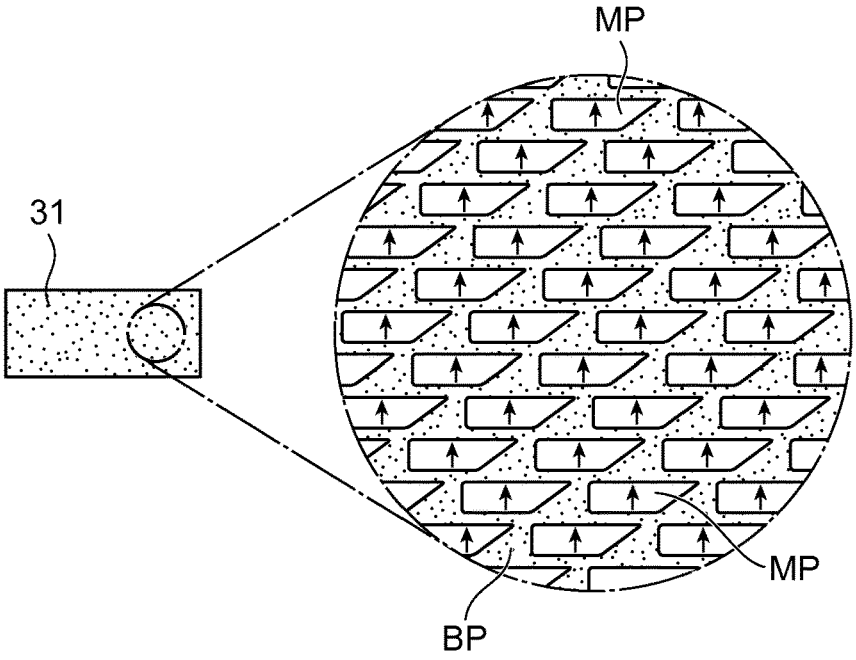

On the other hand, as illustrated in FIG. 6B, the rare-earth magnet main body 31 prepared in the third step shows a magnetic anisotropic crystalline structure.

In this way, the method for manufacturing of a rare-earth magnet of the present invention firstly applies or sprays graphite-based lubricant GF on the inner face of the forming die M, followed by cold forming of the magnetic powder MF in the forming die M, whereby the cold-forming compact 10 is prepared having a surface on which the graphite-based lubricant coat 12 is formed. Then, hot forming is performed to the cold-forming compact 10, whereby the sintered body 20 is prepared having a surface on which the graphite-based lubricant coat 22 is formed. Then, hot deformation processing is performed to this sintered body 20 to manufacture the rare-earth magnet 30. Such a manufacturing method surrounds the magnetic powder MF, the cold-forming compact 10, the sintered body 20 and the rare-earth magnet 30 as a final product with graphite-based lubricant GF and the graphite-based lubricant coats 12, 22, and 32, respectively, during the manufacturing process of the rare-earth magnet 30, whereby contact with the air (oxygen thereof) can be minimized, and so the rare-earth magnet 30 having low oxygen density and having excellent coercive performance can be manufactured without requiring the manufacturing under inert gas atmosphere.

(Experiment to measure the oxygen density and the coercive force of a rare-earth magnet that is manufactured by the manufacturing method of the present invention using graphite-based lubricant, and of a rare-earth magnet that is manufactured by a conventional manufacturing method not using graphite-based lubricant, experiment to measure the oxygen density of various rare-earth magnets manufactured by the manufacturing method of the present invention that are prepared by changing the temperature during hot forming to prepare a sintered body, and results thereof)

The present inventors conducted the experiment to measure the oxygen density and the coercive force of a rare-earth magnet that was manufactured by the manufacturing method of the present invention using graphite-based lubricant, and of a rare-earth magnet that was manufactured by a conventional manufacturing method not using graphite-based lubricant, and the experiment to measure the oxygen density of various rare-earth magnets manufactured by the manufacturing method of the present invention that were prepared by changing the temperature during hot forming to prepare a sintered body.

Example 1

A predetermined amount of rare-earth magnet raw materials (the alloy composition was 29.8Nd-0.2Pr-4Co-0.9B-

0.6Ga-bal.Fe in terms of percent by mass) were mixed, which was then molten in an Ar gas atmosphere, followed by injection of the molten liquid thereof from an orifice to a revolving roll made of Cu with Cr plating applied thereto for quenching, thus preparing a melt-spun ribbon. Then this was pulverized to be magnetic powder. Graphite-based lubricant including graphite powder was applied in an Inconel forming die having the volume of 7.2×28.2×60 mm, and 30 g of the magnet powder was then placed in the forming die. Next, cold forming was performed in the air atmosphere at 23° C., at the rate of stroke of 20 mm/sec, and with the load of 100 MPa, so as to prepare a cold-forming compact. This cold-forming compact was placed in the Inconel forming die having the volume of 7.2×28.2×60 mm, and hot forming was performed in the air atmosphere at 700° C. and with the load of 500 MPa while keeping such a state for 60 sec. so as to prepare a sintered body. This sintered body was placed in a forging die that was prepared separately, and hot deformation processing was performed at the heating temperature of 750° C., at the rate of processing of 75%, and at the rate of strain of 1.0/sec, so as to prepare a rare-earth magnet. From the thus manufactured rare-earth magnet, a test piece of 5.0×5.0×4.0 mm in size was cut out, and the oxygen density was measured and the magnetic properties were evaluated.

Examples 2 and 3

In Example 2, the heating temperature to prepare a sintered body was set at 650° C., and in Example 3, the heating temperature was set at 750° C. Other conditions were the same as those in Experiment 1.

Comparative Example

A rare-earth magnet as comparative example was manufactured by skipping the processing to prepare a cold-forming compact by placing magnetic powder in the forming die to which graphite-based lubricant was applied in the manufacturing method of Example 1. Instead, magnetic powder was placed in a forming die to which no graphite-based lubricant was applied to prepare a sintered body, and hot deformation processing was performed to the sintered body so as to manufacture a rare-earth magnet. The conditions for such processing were the same as those in Example 1.

<Experimental Results>

Figure 7:
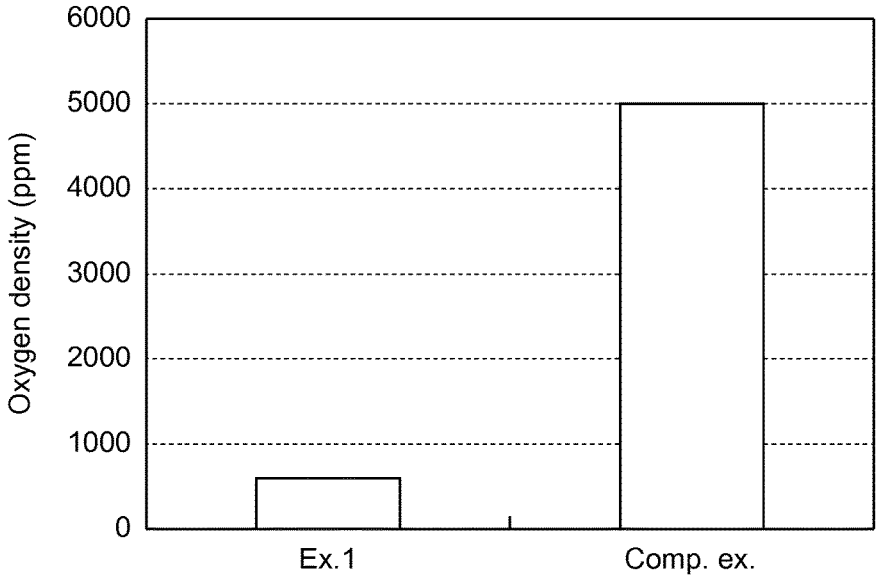
FIG. 7 shows the results of the experiment to measure the oxygen density of a rare-earth magnet that was manufactured by the manufacturing method of the present invention using graphite-based lubricant, and of a rare-earth magnet that was manufactured by a conventional manufacturing method not using graphite-based lubricant.
Figure 8:
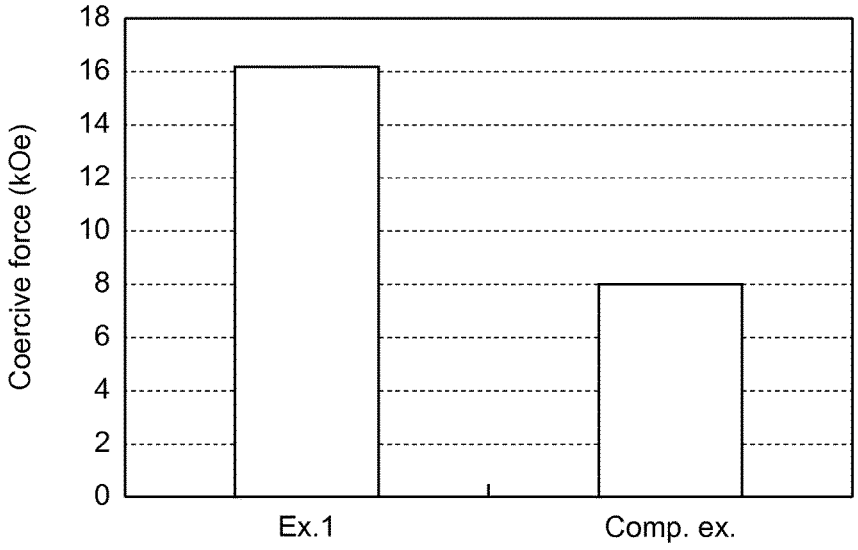
FIG. 8 shows the results of the experiment to measure the coercive force of a rare-earth magnet that was manufactured by the manufacturing method of the present invention using graphite-based lubricant, and of a rare-earth magnet that was manufactured by a conventional manufacturing method not using graphite-based lubricant.
Figure 9:
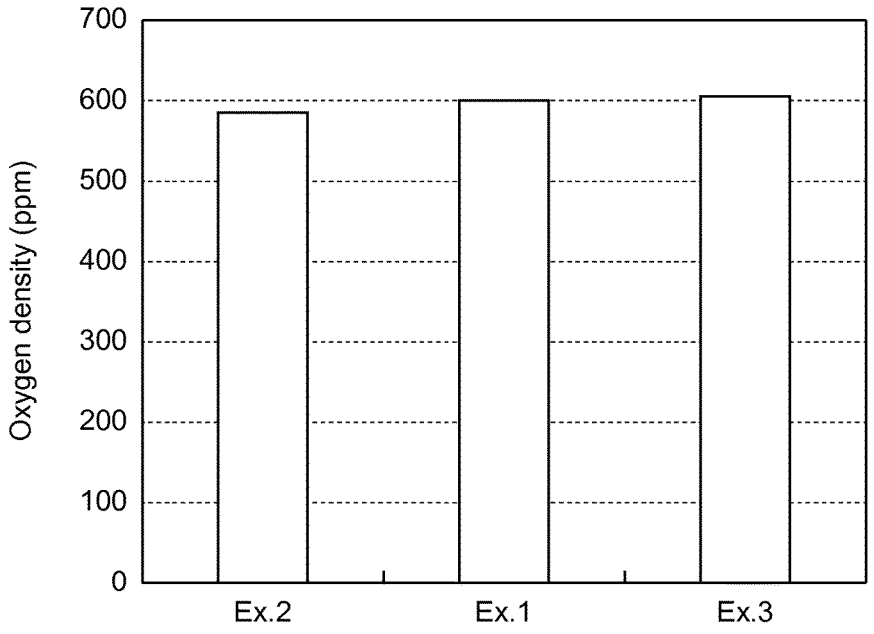
FIG. 9 shows the results of the experiment to measure the oxygen density of various rare-earth magnets manufactured by the manufacturing method of the present invention that were prepared by changing the temperature during hot forming to prepare a sintered body.

The oxygen density of Examples 1 to 3 and Comparative example was measured by an oxygen meter, and the coercive force of Example 1 and Comparative example was measured using a vibrating sample magnetometer (VSM). FIG. 7 shows the experimental results of the measurements of oxygen density for Example 1 and Comparative example, and FIG. 8 shows the experimental result of the measurements of coercive force for Example 1 and Comparative example. FIG. 9 shows the experimental results of the measurements of oxygen density for Examples 1 to 3.

FIG. 7 demonstrates that the oxygen density of Example 1 was 1,000 ppm or less (about 600 ppm), which was decreased to about ⅛ of the oxygen density of Comparative example that was 5,000 ppm. This experimental result shows that the manufacturing method of the present invention including the step of placing magnetic powder in a forming die to which graphite-based lubricant is applied can manufacture a rare-earth magnet having very low oxygen density even when the rare-earth magnet is manufactured in the air atmosphere.

FIG. 8 demonstrates that, while Comparative example had the coercive force of 8 kOe, Example 1 had the coercive force of 16 kOe that was double as the comparative example. Such a difference in coercive force results from a difference in oxygen density contained, and Comparative example had such poor magnetic properties because the oxygen density was high. Specifically, it can be considered that in Example 1, contact of magnetic powder with air was blocked by the graphite lubricant, and contact of the cold-forming compact, the sintered body and the rare-earth magnet with air was blocked by the graphite-based lubricant coats around them, so that oxidation did not progress during hot forming and hot deformation processing, which can contribute to high coercive performance. On the other hand, in Comparative example, contact of the magnetic powder and the sintered body with air during hot forming and hot deformation processing advanced oxidation, resulting in degraded coercive performance.

FIG. 9 demonstrates that, when a sintered body was prepared by hot forming of a cold-forming compact having a graphite-based lubricant coat, the oxygen density hardly increased irrespective of an increase in temperature during hot forming.

Although the embodiments of the present invention have been described in details with reference to the drawings, the specific configuration is not limited to these embodiments, and the design may be modified without departing from the subject matter of the present invention, which falls within the present invention.

DESCRIPTION OF SYMBOLS

10 Cold-forming compact
11 Compact
12 Graphite-based lubricant coat
20 Sintered body
21 Sintered main body
22 Graphite-based lubricant coat
30 Rare-earth magnet
31 Rare-earth magnet main body
32 Graphite-based lubricant coat
M Forming die
R Copper roll
B Melt-spun ribbon (rapidly quenched ribbon)
MF Magnetic powder
GF Graphite-based lubricant (Graphite powder)
D Carbide die
P Carbide punch
MP Main phase (nano-crystalline grains, crystalline grains, crystals)
BP Grain boundary phase

What is claimed is:

1. A method for manufacturing a rare-earth magnet, comprising:

a first step of applying or spraying graphite-based lubricant on an inner face of a forming die, and charging magnetic powder as a rare-earth magnet material in the forming die, followed by cold forming, to form a cold-forming compact having a surface on which a graphite-based lubricant coat is formed;

a second step of placing the cold-forming compact in a cavity of a die containing air and performing hot forming to the cold-forming compact to form a sintered body having a surface on which the graphite-based lubricant coat is formed; and a third step of, in order to give the sintered body anisotropy, performing hot deformation processing to the sintered body to form the rare-earth magnet.

* * * * *